US007014417B2

(12) United States Patent
Salomon

(10) Patent No.: US 7,014,417 B2
(45) Date of Patent: Mar. 21, 2006

(54) AUTO SUCTION HYBRID PUMP

(75) Inventor: Thomas Salomon, Gütersloh (DE)

(73) Assignee: Horn GmbH & Co. KG, Flensburg (DE)

( * ) Notice: Subject to any disclaimer, the term of this patent is extended or adjusted under 35 U.S.C. 154(b) by 79 days.

(21) Appl. No.: 10/496,772

(22) PCT Filed: Nov. 17, 2002

(86) PCT No.: PCT/DE02/04241

§ 371 (c)(1),
(2), (4) Date: May 27, 2004

(87) PCT Pub. No.: WO03/048582

PCT Pub. Date: Jun. 12, 2003

(65) Prior Publication Data

US 2005/0019198 A1 Jan. 27, 2005

(30) Foreign Application Priority Data

Nov. 28, 2001 (DE) ..... 101 58 146

(51) Int. Cl.
*F04D 9/00* (2006.01)

(52) U.S. Cl. ..... 415/47; 415/141; 416/240; 418/153

(58) Field of Classification Search ..... 415/47, 415/140, 141, 125; 416/240; 418/226–286, 418/152

See application file for complete search history.

(56) References Cited

U.S. PATENT DOCUMENTS 2,258,371 A 10/1941 Wernert
2,404,678 A * 7/1946 Erb ..... 416/145
3,080,824 A 3/1963 Boyd
4,990,074 A 2/1991 Nakagawa
5,993,158 A * 11/1999 Young ..... 416/132 R
6,203,302 B1 * 3/2001 Maki ..... 418/54
6,264,450 B1 * 7/2001 Woodruff ..... 418/153

FOREIGN PATENT DOCUMENTS

| | | |
|---|---|---|
| DE | 10 02 630 | 2/1957 |
| DE | 195 45 045 | 3/1997 |
| FR | 1 154 842 | 4/1958 |

* cited by examiner

*Primary Examiner*—Edward K. Look
*Assistant Examiner*—Nathan Wiehe
(74) *Attorney, Agent, or Firm*—Collard & Roe, P.C.

(57) ABSTRACT

A hybrid pump (1) with a housing (2) comprising at least one suction port (10) and at least one pressure port (11). A rotor (5) is eccentrically arranged in the housing chamber (3) which is substantially enclosed in a circular manner. The rotor (5) has a plurality of circumferentially spaced vanes (6) which are radially arranged at least in some segments and are made of a material that is resiliently deformable under centrifugal force. The eccentricity (14) of the rotor (5) in relation to the housing chamber (3) and the elasticity of the rotor vane (6) are such that in a first phase of low rotational speed, the radially distant end areas (7) of each vane (6) touch only some or no circumferential segments (4) of the housing chamber (3) in the course of one rotor (5) rotation, whereas in a second phase of higher rotational speed, the radially distant end areas (7) of all vanes (6) touch the inner wall (4) of the housing chamber (3) essentially during the entire rotor (5) rotation.

19 Claims, 5 Drawing Sheets

AUTO SUCTION HYBRID PUMP

CROSS REFERENCE TO RELATED APPLICATIONS

Figure 1:
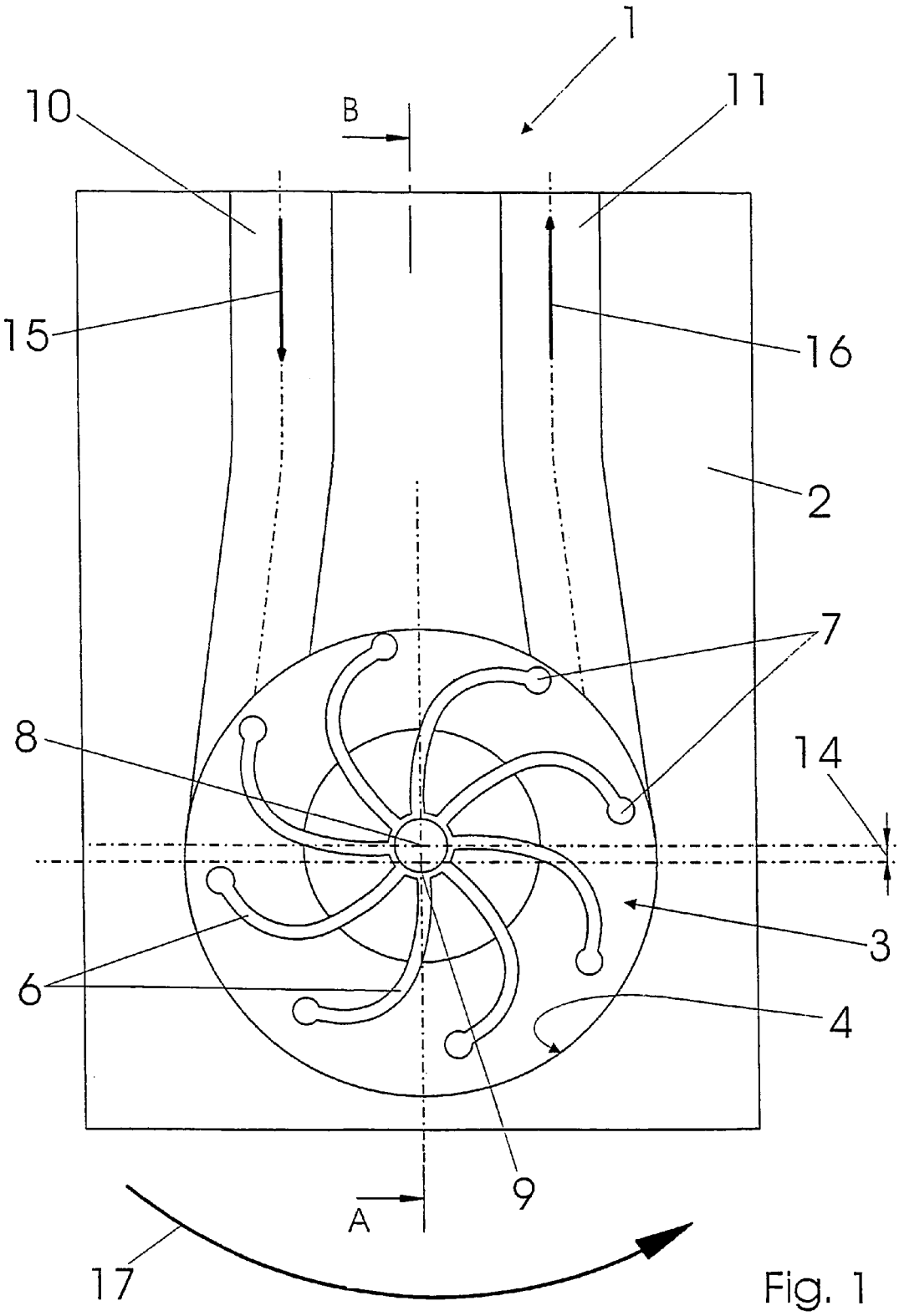

Applicant claims priority under 35 U.S.C. §119 of German Application No. 101 58 146.7 filed on Nov. 28, 2001. Applicants also claim priority under 35 U.S.C. §365 of PCT/DE02/04241 filed on Nov. 17, 2002. The international application under PCT article 21(2) was not published in English.

The invention relates to a hybrid pump as disclosed herein.

In the design of pumps for transporting fluids, particularly liquids, the problem is that while a high degree of effectiveness and a low operating noise of the pump can be achieved with known rotary pumps, these pumps are not self-priming, in other words they cannot draw in a column of liquid from the stopped state, by themselves, if the rotary pump contains air. This is particularly disadvantageous if such pumps have only short operating times and the transported column of liquid runs out of the interior of the pump again, when the pump is stopped, due to a height difference. Therefore rotary pumps often have additional units with which the column of liquid can be transported into the housing chamber, before the actual operation of the rotary pump begins, and the rotary pump therefore does not run dry, but rather the housing chamber is filled with liquid, right from the start.

Other pump designs such as impeller pumps of a known design are self-priming, but they have only a low degree of effectiveness, since the internal friction of the pump must be overcome, for example.

Another design of pumps is represented by vane pumps, in which vanes that are arranged to stand radially away from a rotor separate partial volumes of the housing chamber, and liquid is transported in these, during rotation of the rotor, in each instance. The main disadvantage here is that the vanes of the vane pumps must be fitted very accurately, since they are arranged to move relative to the rotor, and that great wear of the pump occurs due to the friction between the vanes and the inner wall of the housing. The positive aspect is that vane pumps are self-priming even when they contain air.

DE 195 45 045 A1 shows such a vane pump, which has been developed further; here, the vanes of the vane pump are attached to a rotor and are configured to be elastic, so that the vanes of the rotor, which are curved to promote flow, move along the inner surface of the housing chamber during the entire rotation movement, and rest against it under variable bias. In this way, the vanes of the rotor separate individual volumes within the housing chamber from one another, whereby a corresponding transport of a fluid and a pressure build-up are possible, in a manner fundamentally known for vane pumps, because of the eccentricity between the rotor and the housing chamber. The flexibility of the vanes of the rotor, which are shaped to promote flow, has the advantage, in this connection, that only slight wear occurs between the inner wall of the housing and the vanes of the rotor, since the vanes adapt to the different distances from the inner wall of the housing under elastic bias, and rest against the inner wall of the housing. However, the degree of effectiveness of this pump is also not particularly high, because of the design, and also, wear is significantly greater as compared with rotary pumps.

It is therefore the task of the present invention to develop a pump that is self-priming on the one hand, and, at the same time, can work at high degrees of effectiveness, and furthermore is inexpensive to manufacture.

The solution of the task according to the invention is evident from the characterizing features disclosed hereafter, in interaction with the characteristics of the preamble. Other advantageous embodiments of the invention are discussed hereafter.

The invention proceeds from a pump having a housing, into which at least one suction connection and one pressure connection open, and in the housing chamber of which a rotor is arranged eccentrically; the housing chamber is enclosed essentially in circular manner, and the rotor has a number of rotor vanes on its circumference, which are spaced apart, and radially arranged at least in some sections, and made of a material that is resiliently, elastically deformable under the influence of centrifugal force. Such a pump is developed further in that the eccentricity of the rotor relative to the housing chamber, as well as the elasticity of the rotor vanes are selected in such a manner that in a first range of low rotational speed, each rotor vane does not rest against circumference segments of the housing chamber with its radially distant end region, or rests against them only part of the time, during a revolution of the rotor, whereas in a second range of greater rotational speed, all of the rotor vanes rest against the inner wall of the housing chamber with their radially distant end regions, under the influence of centrifugal force, essentially during the entire revolution of the rotor. In this way, it is possible to operate the hybrid pump in such a manner, in the first range of its speed of rotation, that it works predominantly as a pure flow pump, essentially corresponding to a rotary pump. After a threshold value for the speed of rotation has been exceeded, however, the hybrid pump changes its operating behavior, in that the rotor vanes deform elastically, under the influence of centrifugal force, to such an extent that they rest against the inner wall of the housing chamber with their radially distant end regions, essentially during the entire revolution of the rotor, and thereby separate partial volumes of the housing chamber from one another, in liquid-sealed manner. This makes it possible to guarantee self-priming of a column of liquid, using the hybrid pump that is essentially working like a conventional vane pump, even if the hybrid pump was previously n the air-filled state, because it was shut down, for example. If the hybrid pump has run empty because of being shut down, a drive motor will accelerate the hybrid pump, which works without containing liquid, to its maximum speed of rotation, very quickly, so that the hybrid pump is operated in the second range of a higher speed of rotation practically immediately, and works as a vane pump in this operating state, so to speak, in self-priming manner, and transports liquid into the housing chamber. Once the pump has then been filled with liquid as a result, the speed of rotation of the drive motor will drop, because of the counteracting torques and the influence of the liquid, to such an extent that the operating state of the hybrid pump changes over to the first range of a low speed of rotation, in which the hybrid pump works essentially like a rotary pump, and transports the liquid at a high degree of effectiveness. This transition between the two operating states therefore ensures operation of the hybrid pump even in case of disturbances that can occur when the column of liquid tears off, as can happen in pure rotary pumps. In this case, the hybrid pump automatically switches over to higher speeds of rotation, after air has entered the pump, and this restores the self-priming operating state corresponding to a vane pump, with which the liquid can be drawn in again and, after the hybrid pump has been filled again, the decrease in speed of rotation occurs once again.

The hybrid pump according to the invention therefore offers two essential functions of pumps, namely self-priming and operation at high degrees of effectiveness, in a single pump design. As a result, the hybrid pump according to the invention is particularly suited for areas of use in which frequently only short-term operation at full transport capacity is demanded, while, at the same time, it cannot be avoided that the column of liquid drops out of the pump, due to frequent shut-downs. In the case of known pump designs, complicated designs having kick-back valves or the like must otherwise be provided, in order to hold the column of liquid in the pump; these are expensive and prone to failure, and furthermore also have a negative influence un the degree of effectiveness of the pump, since the suction line can no longer be designed to be as continuously open, because of these installations. Such measures can otherwise not be avoided, for example for pumps for filling containers as needed, for example with which fuel in relatively small amounts is drawn from a storage container, for filling it into vehicles. Of course, a great variety of such uses of the hybrid pump according to the invention is possible.

An advantageous embodiment provides that the elastic deformability of the rotor vanes is selected in such a manner that starting from a certain speed of rotation of the rotor, the deformation of the rotor vanes as a result of the centrifugal force balances out the eccentricity, so that essentially all the ends of the rotor vanes rest against the inner wall of the housing chamber and form compression spaces that are separate from one another. In this connection, the transport behavior that results from the eccentricity of the hybrid pump can be adjusted as a function of the elasticity of the rotor vanes, in such a manner that starting from a limit speed of rotation, the rotor vanes rest not only against parts of the circumference surface of the housing chamber, but rather are in contact with it during the entire revolution, and thereby separate the partial volumes of the housing chamber from one another, as this is fundamentally known for conventional vane pumps. Thus, during operation of the hybrid pump as a pure flow pump, corresponding to a rotary pump, below the limit speed of rotation, there is no wear, or wear is only very slight, because of the absence of friction between the rotor vanes and the inner wall of the housing, to a great extent, and the rotor vanes rest against the inner wall of the housing only for filling the housing chamber with liquid, by means of self-priming, during operation corresponding to a vane pump. In this way, the wear of the rotor vanes during operation is minimized. Additionally, the hybrid pump can also transport media that are contaminated with particles, since the deformability of the rotor vanes permits corresponding deformations during the passage even of larger particles, which would cause rigid rotor vanes to break.

It is advantageous if each rotor vane has a curved cross-sectional shape, which promotes flow, whereby each rotor vane touches at least one point of the inner wall of the housing chamber, under elastic bias, even at a slow speed of rotation of the rotor. In this way, the interior of the hybrid pump is divided into two separate regions and, at the same time, because of the cross-sectional shape, both the elasticity of the rotor vanes and their contact with the inner wall of the housing can be adapted to different operating conditions, under bias, within broad limits. In this connection, it is advantageous if the rotor vanes have a vane-shaped curvature and are resiliently, elastically deformable in the circumference direction.

An improved effect with regard to the elastic deformation of the rotor vanes can be achieved if tribological forces of the fluid to be transported act on each rotor vane during operation of the hybrid pump in the first range of a low speed of rotation, which forces deform the rotor vanes in the direction towards the axis of rotation of the rotor. In this way, despite relatively elastic materials of the rotor vanes, they are prevented from already resting against the inner wall of the housing at a relatively low speed of rotation, since the tribological forces of the fluid to be transported counteract the elastic deformation under the centrifugal force due to rotation of the rotor. Therefore the limit speed of rotation can be relatively high, so that in the operating state of the hybrid pump corresponding to a rotary pump, adequate transport performance can be achieved. Furthermore, the operating behavior of the hybrid pump also depends on the medium being transported, because of the deformability of the rotor vanes. In the case of fluids having low viscosity, a different deformation will occur, because of the difference in viscosity, at the same speed of rotation as compared with high-viscosity fluids or, even gases, whereby the centrifugal effects also play a role.

A possible embodiment provides that the rotor vanes are made of a plastic material, preferably of thermoplastic materials or polyurethane or EPDM or nitrile or neoprene. Such materials offer sufficient deformability and, at the same time, a high level of shape retention, even under long-term stress. At the same time, such materials can be inexpensively processed, for example using injection-molding methods, and thereby the rotor vanes and the entire rotor can be produced inexpensively. Also, the running behavior of the hybrid pump is very low in noise.

This can be achieved, in a first embodiment, in that the rotor and the rotor vanes are formed in one piece. Here, the rotor and the rotor vanes can be molded at the same time and in one piece, for example, in a single processing step, using injection molding or other production methods. In this way, the number of parts of the pump is drastically reduced, thereby additionally lowering the assembly costs and increasing the operational reliability. Also, in another embodiment, it is possible that the rotor vanes made of the resilient, elastic material are inserted into assigned recesses of the rotor and fixed in place there. This makes it possible for the rotor itself to be made of a different material from the rotor vanes, for example with regard to strength properties or other general conditions.

Furthermore, it is advantageous if essentially cylindrical thickened regions are arranged at the ends of the rotor vanes that are radially distant from the rotor, which regions rest against the inner wall of the housing chamber, forming a seal, and separate individual cells of the hybrid pump from one another, in the manner of a vane pump. These thickened regions, which are subject to corresponding wear due to the friction against the inner wall of the housing, thereby extend the useful lifetime of the rotor, because of their extensive masses relative to the rotor vanes themselves and, at the same time, they form a corresponding mass distribution for the centrifugal forces that act on them, and a greater contact surface of the rotor vanes on the inner walls of the housing chamber.

It is advantageous if the eccentricity of the arrangement of the rotor lies in the range of up to 20%, preferably up to 2% of the outside diameter of the rotor, including the rotor vanes. Such a value for the eccentricity can be easily bridged with the deformation of the rotor vanes, without endangering the strength properties of the rotor vanes.

A particularly simple structure of the hybrid pump can be implemented if the rotor and the housing consist of essentially disk-shaped basic shapes, which can be connected with one another to form a fluid seal. In this way, prefinished components can be assembled in simplified manner, and also, the fluid seal of the individual parts relative to one another is simple to implement, by way of the large contact areas of the individual disk-shaped basic shapes.

Furthermore, it is possible that the entry and/or exit of the fluid into and out of the housing chamber takes place perpendicular to the axis of rotation of the rotor of the hybrid pump. In this connection, the fluid essentially flows up to the circumference of the rotor vanes at a tangent. In another embodiment, it is also possible that the entry and/or exit of the fluid into and out of the housing chamber takes place parallel to the axis of rotation of the rotor of the hybrid pump.

Furthermore, it is possible that a universal motor can be used as the drive of the hybrid pump.

A particularly preferred embodiment of the hybrid pump according to the invention is shown in the drawing.

Figure 2:
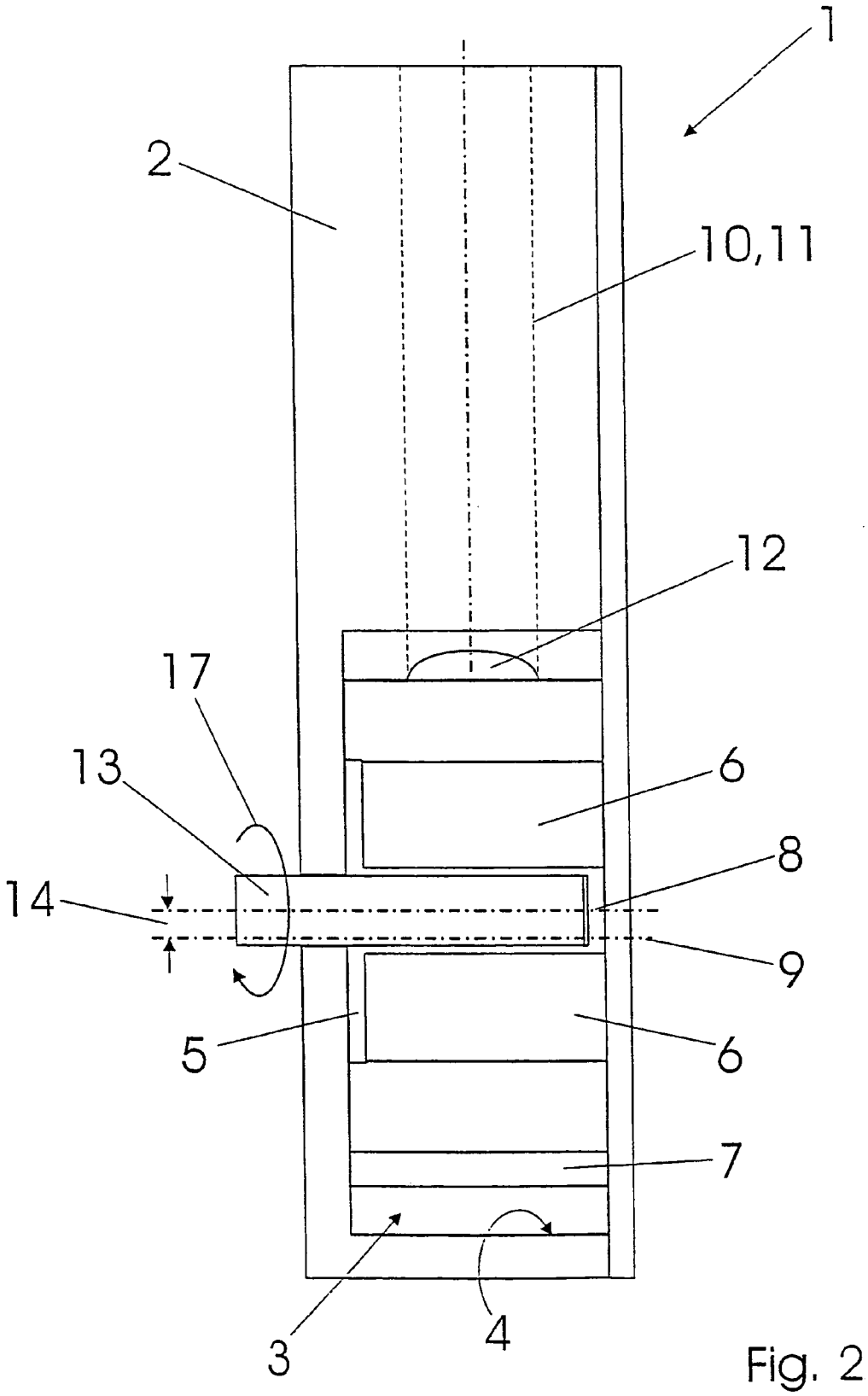
Figure 3:
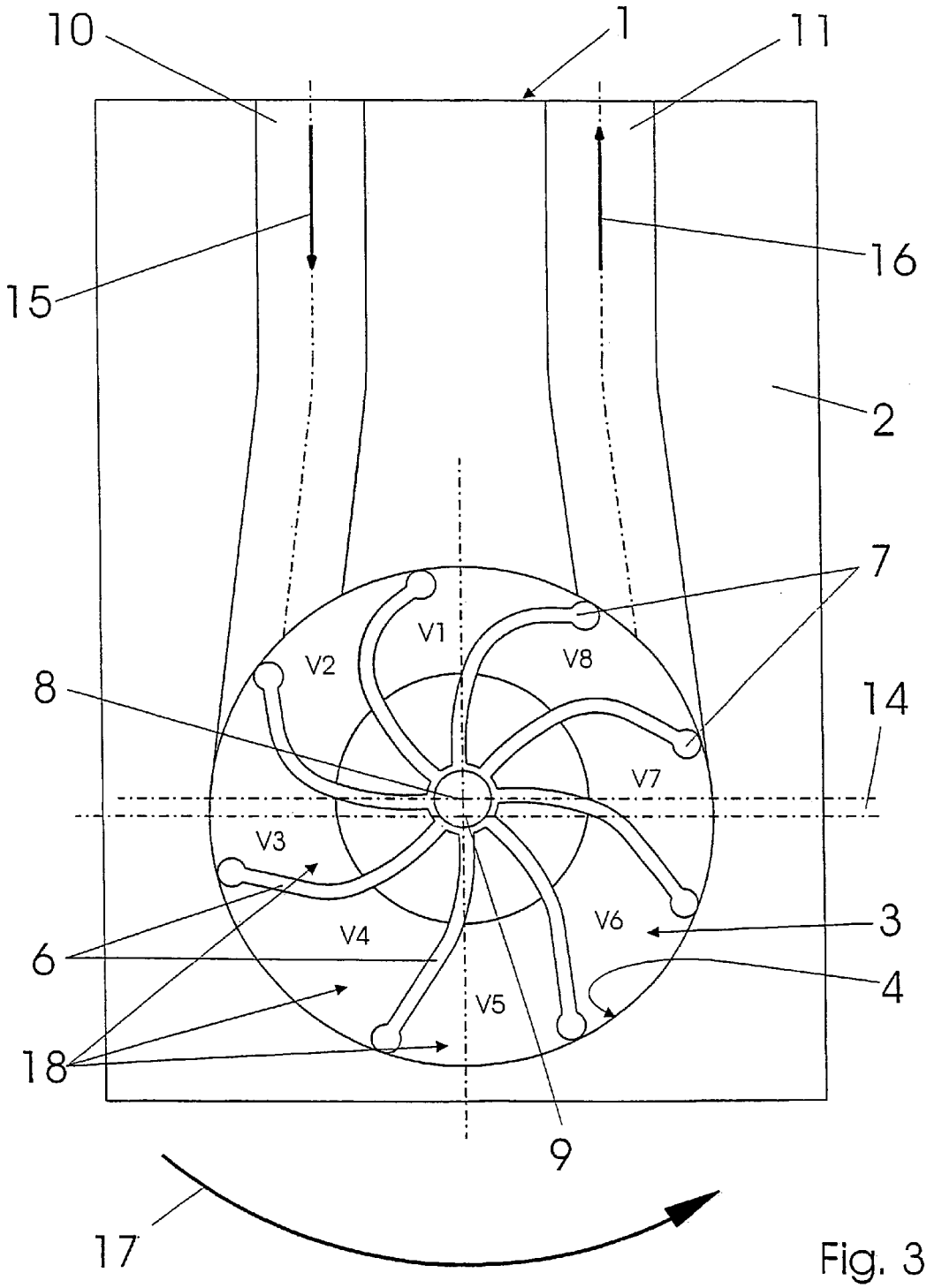
Figure 4:
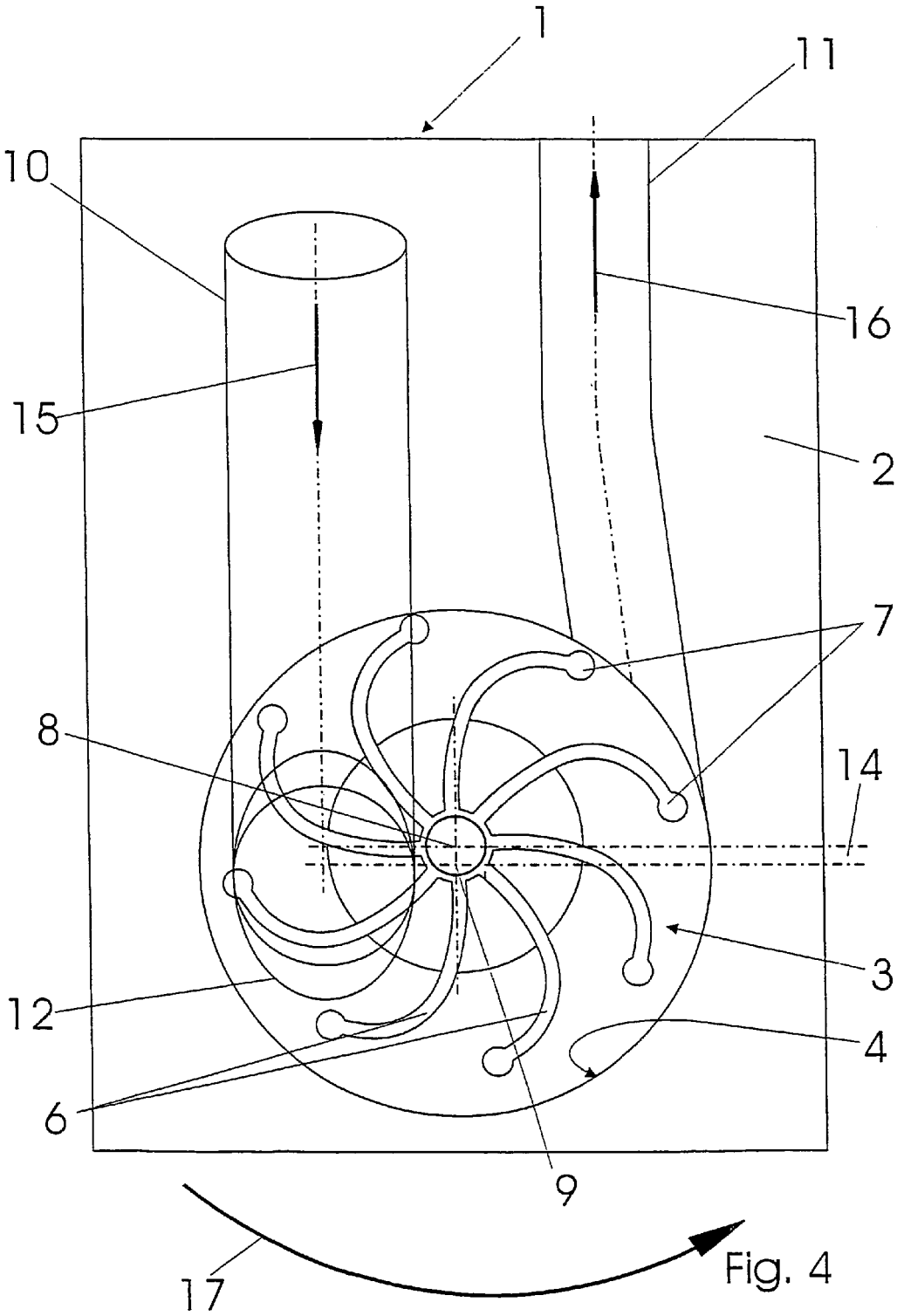
Figure 5:
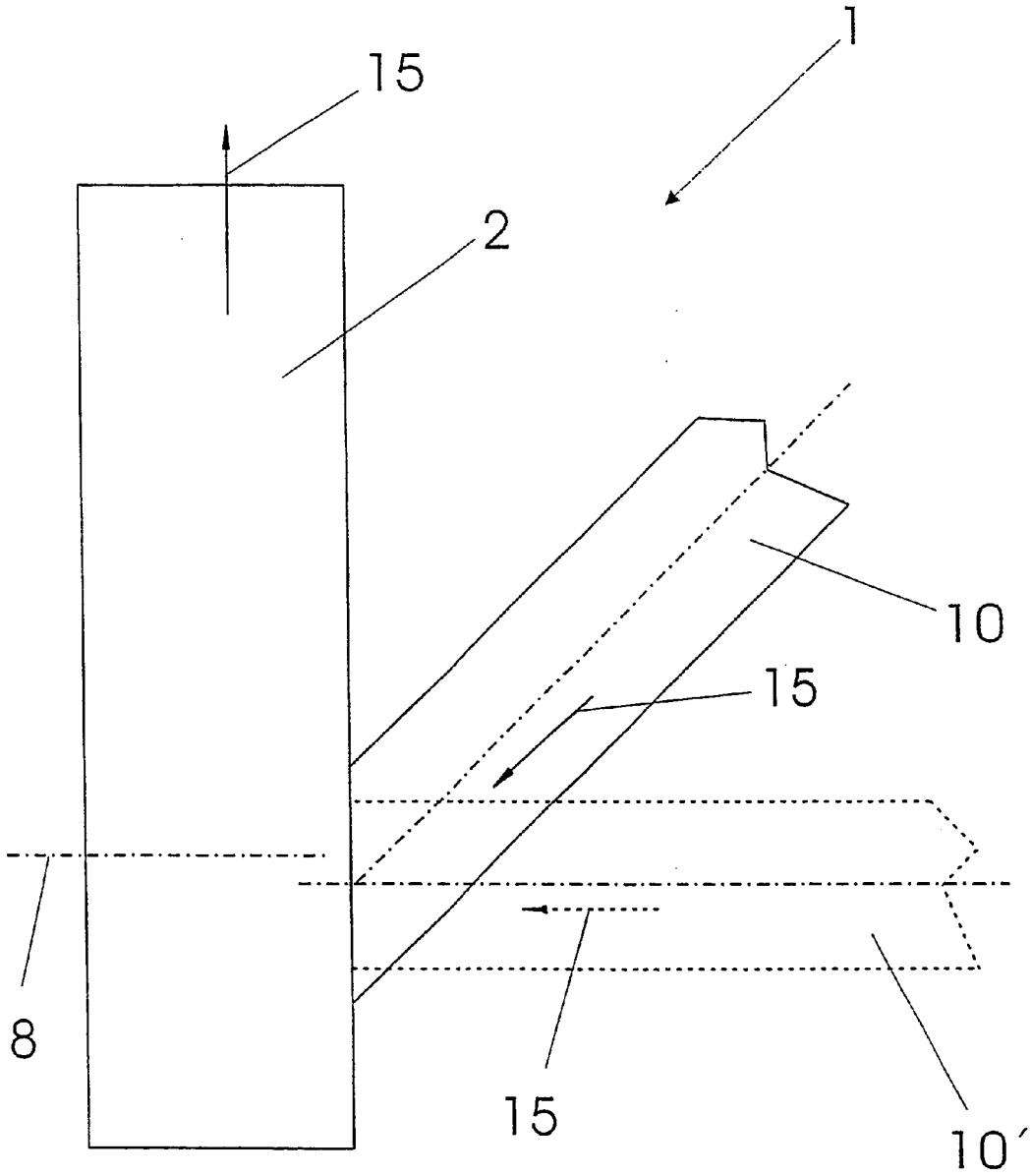

This shows:

FIG. 1 a first section-through a hybrid pump according to the invention, in a schematic representation, at a low speed of rotation, in the operating state corresponding to a rotary pump, FIG. 2 a section along the line AB through the hybrid pump according to FIG. 1, FIG. 3 a section through a hybrid pump according to the invention, according to FIG. 1, at a higher speed of rotation, in the operating state corresponding to a vane pump, FIG. 4 a variation of the hybrid pump according to the invention according to FIG. 1, having an inlet inclined at a slant to the axis of rotation of the rotor, FIG. 5 a side view of the hybrid pump according to FIG. 4, with two possible arrangements of the suction channel.

FIG. 1 shows a schematic representation of a section through a hybrid pump 1 according to the invention, whereby the section runs approximately in the parting plane of the housing 2 of the hybrid pump 1, which housing is configured in plate shape. Here, the intake channel 10 and the outlet channel 11 as well as the housing chamber 3 can be seen, in which a rotor 5 having rotor vanes 6 attached to it is mounted to rotate about an axis of rotation 8. Here, the axis of rotation 8 has an eccentric arrangement relative to the axis of symmetry 9 of the housing chamber 3, whereby the amount of the eccentricity is indicated under the item number 14. The arrangement of the axis of rotation 8 and the axis of symmetry 9, as well as the essential structure of such a hybrid pump 1, is fundamentally known, for example from DE 195 45 045 A1, and therefore does not need to be explained here other than as needed for the present invention.

It is different as compared with the known vane pumps, however, that in the hybrid pump 1 according to the invention, the rotor vanes 6 of the rotor 5 do not rest against the inner wall 4 of the housing chamber 3, or only rest against it partially, in the state of rest of the hybrid pump 1, i.e. below a limit speed of rotation. In this connection, the rotor vanes 6 are formed of an elastically deformable material, which can deform, from the vane-like configuration according to FIG. 1, under the effect of centrifugal force as the rotor 5 rotates along the direction of rotation 17, in such a manner that the cylindrical thickened regions 7 at the ends of the rotor vanes 6 move radially outward more and more, as the speed of rotation increases, and rest against the inner wall 4 of the housing chamber 3 over an ever increasing circumference length during the revolution. After the limit speed of rotation has been exceeded, the thickened regions 7 of the rotor vanes 6 are then in constant contact with the inner wall 4 of the housing chamber 3, as can be seen in greater detail in FIG. 3.

Under the influence of the centrifugal force, the rotor vanes 6 figuratively stand away radially outward from the axis of rotation 8, and rest against the inner wall 4 more and more. In this connection, the rotor vanes 6 also change their curved cross-sectional shape slightly, in that the rotor vanes 6 pass over into a stretched configuration in the regions along the circumference direction of the inner wall 4 of the housing that are further removed from the axis of rotation 8 of the rotor 5. In those regions along the circumference direction of the inner wall 4 of the housing, which again are arranged closer to the axis of rotation 8 of the rotor 5, this stretched configuration will spring back again and return to the configuration that can be seen in this region, in FIG. 1 and FIG. 3, respectively.

The material of the rotor vanes 6 can consist, for example, of thermoplastic materials, polyurethanes, EPDM, nitrile, or neoprene, whereby such materials have both a relatively great elastic deformability and great strength and low friction wear under stress due to friction-related contact.

In this connection, as can be better seen in FIG. 2, the rotor 5 with the rotor vanes 6 arranged on it is fixed in place on a drive shaft 13, to which a drive motor, not shown, is attached by means of a flange.

The function of the hybrid pump 1 according to the invention can be described as follows, in a comparison of the principles of the rotary pump and the vane pump combined in the hybrid pump 1.

A conventional rotary pump is not self-priming, so that before such a rotary pump is started up, a fluid must be introduced into the rotary pump, into the suction side 10 and through the inlet 12. If the rotary pump is then put into operation, a volume flow of the fluid is transported by way of the rotor 5 and the rotor vanes 6, through the suction side 10, in the inflow direction 15, so that the rotary pump no longer runs dry. After having passed through the housing chamber, this volume stream exits from the rotary pump again, through the pressure side 11, in the outflow direction 16. At relatively low speeds of rotation, below the limit speed of rotation, the hybrid pump according to the invention demonstrates essentially these properties, since the rotor vanes 6 have no contact, or only contact at certain times, with the inner wall 4 of the housing, as is the case in a rotary pump.

By means of the eccentric arrangement of the rotor 5 in the hybrid pump 1 according to the invention, however, the compression spaces 18 form at higher speeds of rotation, as can be better seen in FIG. 3, because of the deformation of the rotor vanes 6, whereby the smallest volume is present in the compression space V1, and the volumes of the compression spaces V2, V3, and V4 each become larger, until starting with the compression space V5 until the compression space V8, the volume decreases again. In this way, a structure and an operating state like that of a vane pump results from the change in shape of the rotor vanes 6, due to the effect of centrifugal force, as does an operating state of the hybrid pump like that of a vane pump, if the speed of rotation of the rotor 5 exceeds a limit speed of rotation, at which all of the rotor vanes 6 rest against the inner wall 4 of the housing chamber 3 over the entire circumference of a revolution. As a result, the hybrid pump 1 according to the invention is self-priming in this operating state, i.e. the fluid is drawn in automatically in the inflow direction 15, within certain limits, so that the chamber 3 of the housing 2 can automatically fill with fluid.

Such behavior, which is fundamentally known from conventional vane pumps, also occurs in the hybrid pump according to the invention, but only if the speed of rotation of the rotor 5 exceeds a limit value. Previously, because of the relatively large eccentricity 14 and the starting configuration of the rotor vanes 6 in the unstressed state, it is not guaranteed that the compression spaces 18 will be established, since the thickened regions 7 at the ends of the rotor vanes 6 do not rest against the inner wall 4 of the housing chamber 3, forming a seal, as is clearly evident in FIG. 1. Therefore, in this operating state, of which FIG. 1 shows only one state that depends on the speed of rotation, transport of the fluid as it occurs in a conventional vane pump is not guaranteed. In this operating state, however, the rotor 5 and the rotor vane 6 work like a conventional flow pump, corresponding to a rotary pump.

Only when the limit speed of rotation has been exceeded, at which the centrifugal forces on the rotor vanes 6 become so great that the ends 7 of the rotor vanes 6 rest against the inner wall 4 of the housing chamber 3 over the entire revolution, the self-priming operation of the hybrid pump 1, in accordance with a vane pump, will start.

This self-priming property of the hybrid pump 1 according to the invention has the significant advantage that the use of the hybrid pump 1 does not require any prior filling of the pump chamber, which would otherwise have to be performed either manually or by means of additional devices. Without the user of such a hybrid pump 1 noticing, fluid is drawn in, in the operating state of the hybrid pump 1 in accordance with a vane pump, when the hybrid pump 1 is in the air-filled state, since the drive motor essentially runs empty and thereby reaches a high speed of rotation, above the limit speed of rotation, and then, after priming has taken place, the hybrid pump 1 automatically goes over into transport operation, in accordance with a rotary pump, which allows a high degree of effectiveness at low wear. This is always particularly practical if such pumps are in operation only for short periods of time and then are put into operation again after an extended period of shut-down. Conventional pumps frequently run empty during this time, so that the corresponding measures have to be taken for filling the pump, in advance. Such fields of use apply, for example, in connection with the refilling of containers, for example in filling fuel into vehicles from corresponding canisters or barrels, but also in a large variety of other possible areas of use.

FIG. 4 shows a cross-sectional view, and FIG. 5 shows a related side view, of a corresponding hybrid pump 1 according to the invention, in which the suction channel 10 does not run within the plane perpendicular to the axis of rotation of the rotor 5. In this way, it is possible to undertake the inflow of the fluid through the suction channel 10 in the inflow direction 15, either at an angle of 45 degrees, for example, as shown with the solid lines in FIG. 5, whereby of course it is also possible to implement an inflow direction 15' by means of an intake channel 10' shown with a broken line, essentially parallel to the axis of rotation 8 of the rotor 5. This can be of interest for specific applications, in terms of flow technology.

Reference Number List

1—hybrid pump
2—housing
3—housing chamber
4—inner wall of housing
5—rotor
6—rotor vane
7—thickened regions
8—axis of rotation, rotor
9—axis of symmetry, housing chamber
10—suction channel
11—pressure channel
12—inlet
13—drive shaft
14—eccentricity
15—inflow direction
16—outflow direction
17—direction of rotation, rotor
18—compression spaces

What is claimed is:

1. Hybrid pump (1) having a housing (2), into which at least one suction connection (10) and one pressure connection (11) open, and in the housing chamber (3) of which, which is enclosed essentially in circular manner, a rotor (5) is arranged eccentrically, which has a number of rotor vanes (6) on its circumference, which are spaced apart, and radially arranged at least in some sections, and made of a material that is resiliently, elastically deformable, wherein the eccentricity (14) of the rotor (5) relative to the housing chamber (3), as well as the elasticity of the rotor vanes (6) are selected in such a manner that in a first range of low rotational speed, each rotor vane (6) does not rest against circumference segments (4) of the housing chamber (3) with its radially distant end region (7), or rests against them only part of the time, during a revolution of the rotor (5) so that the hybrid pump (1) works in a not self-priming manner, whereas in a second range of greater rotational speed, all of the rotor vanes (6) rest against the inner wall (4) of the housing chamber (3) with their radially distant end regions (7), under the influence of centrifugal force, essentially during the entire revolution of the rotor (5) so that the hybrid pump (1) works in a self-priming manner.

2. Hybrid pump (1) according to claim 1, wherein the elastic deformability of the rotor vanes (6) is selected in such a manner that starting from a certain speed of rotation of the rotor (5), the deformation of the rotor vanes (6) as a result of the centrifugal force balances out the eccentricity (14), so that essentially all the ends (7) of the rotor vanes (6) rest against the inner wall (4) of the housing chamber (3) and form compression spaces (18) that are separate from one another, corresponding to a vane pump.

3. Hybrid pump (1) according to claim 1, wherein each rotor vane (6) has a curved cross-sectional shape, which promotes flow, whereby each rotor vane (6) touches at least one point of the inner wall (4) of the housing chamber (3), under elastic bias, even at a slow speed of rotation of the rotor (5).

4. Hybrid pump (1) according to claim 1, wherein in the first range of a low speed of rotation, the hybrid pump (1) works exclusively or predominantly as a flow pump, similar to a rotary pump.

5. Hybrid pump (1) according to claim 4, wherein the operation of the hybrid pump (1) does not permit self-priming of a liquid medium in the first range of a low speed of rotation.

6. Hybrid pump (1) according to claim 4, wherein in the operation of the hybrid pump (1) in the first range of a low speed of rotation, tribological forces of the fluid to be transported act on each rotor vane (6), which deform the rotor vane (6) in the direction towards the axis of rotation (8) of the rotor (5).

7. Hybrid pump (1) according to claim 1, wherein in the second range of the higher speed of rotation, the hybrid pump (1) works exclusively or predominantly as a displacement pump, similar to a vane pump.

8. Hybrid pump (1) according to claim 7, wherein the operation of the hybrid pump (1) allows a high degree of effectiveness in the first range of the low speed of rotation.

9. Hybrid pump (1) according to claim 1, wherein the rotor vanes (6) have a vane-shaped curvature and are resiliently, elastically deformable in the circumference direction (17).

10. Hybrid pump (1) according to claim 1, wherein the rotor vanes (6) are made of a plastic material.

11. Hybrid pump (1) according to claim 1, wherein the rotor (5) and the rotor vanes (6) are formed in one piece.

12. Hybrid pump (1) according to claim 1, wherein the rotor vanes (6) made of resilient, elastic material are inserted into assigned recesses of the rotor (5) and fixed in place there.

13. Hybrid pump (1) according to claim 1, wherein essentially cylindrical thickened regions (7) are arranged at the ends of the rotor vanes (6) that are radially distant from the rotor (5), which regions rest against the inner wall (4) of the housing chamber (3), forming a seal, and separate individual cells (18) from one another.

14. Hybrid pump (1) according to claim 1, wherein the eccentricity (14) of the arrangement of the rotor (5) lies in the range of up to 20% of the diameter of the rotor (5).

15. Hybrid pump (1) according to claim 1, wherein the volumes of the compression spaces (18) vary, starting from a minimum in the region of the suction side (10), by way of a maximum, to a minimum in the region of the pressure side (11) of the hybrid pump (1).

16. Hybrid pump (1) according to claim 1, wherein the rotor (5) and the housing (2) consist of essentially disk-shaped basic shapes, which can be connected with one another to form a fluid seal.

17. Hybrid pump (1) according to claim 1, wherein the entry (10) and/or the exit (11) into and out of the housing chamber (3) takes place perpendicular to the axis of rotation (8) of the rotor (5) of the hybrid pump (1).

18. Hybrid pump (1) according to claim 17, wherein the entry (10) and/or exit (11) of the fluid into and out of the housing chamber (3) takes place parallel to the axis of rotation (8) of the rotor (5) of the hybrid pump (1), at least with one component.

19. Hybrid pump (1) according to claim 1, wherein a universal motor can be used as the drive of the hybrid pump (1).

* * * * *